US007410196B2

(12) United States Patent
Stein

(10) Patent No.: US 7,410,196 B2
(45) Date of Patent: Aug. 12, 2008

(54) ELECTRONIC TONGUE STRIKE MECHANISM

(75) Inventor: John W. Stein, Allentown, PA (US)

(73) Assignee: Everlokt Corporation, Allentown, PA (US)

( * ) Notice: Subject to any disclaimer, the term of this patent is extended or adjusted under 35 U.S.C. 154(b) by 102 days.

(21) Appl. No.: 11/222,404

(22) Filed: Sep. 8, 2005

(65) Prior Publication Data

US 2006/0049648 A1 Mar. 9, 2006

(51) Int. Cl.
*E05B 15/02* (2006.01)
*E05B 15/00* (2006.01)

(52) U.S. Cl. ..... 292/341.15; 292/341.16; 292/341.17; 70/432

(58) Field of Classification Search ..... 292/251.5, 292/23, 73, 340, 341.15, 341.16, 341.1, 341.17; 70/432, 278.7
See application file for complete search history.

(56) References Cited

U.S. PATENT DOCUMENTS 2,066,277 A * 12/1936 Keil ..... 292/341.16
2,741,505 A * 4/1956 Clark ..... 292/341.17
4,595,220 A * 6/1986 Hanchett et al. ..... 292/341.17
4,717,909 A * 1/1988 Davis ..... 340/686.4
5,076,625 A 12/1991 Oxley
5,118,150 A 6/1992 Jarrett
5,195,792 A 3/1993 Stendal
5,681,070 A * 10/1997 Williams et al. ..... 292/341.16
5,757,269 A 5/1998 Roth et al.
5,825,288 A * 10/1998 Wojdan ..... 340/542
5,943,888 A * 8/1999 Lawson ..... 70/278.7

* cited by examiner

*Primary Examiner*—Carlos Lugo
(74) *Attorney, Agent, or Firm*—Barley Snyder LLC

(57) ABSTRACT

An electronic tongue strike mechanism which can be mounted in a door frame is disclosed. The electronic tongue strike mechanism has a main mounting bracket which is mountable to a door frame, a tension plate which is mounted to the main mounting bracket a tongue strike mounted on the tension plate for engaging a door bolt and a pressure sensor mounted on the tension plate to sense relative movement between the tension plate and the main mounting bracket caused by the door bolt being urged against the tongue strike. The pressure sensor feeds electronics which operate to control release of the tongue strike.

31 Claims, 8 Drawing Sheets

Figure 1A
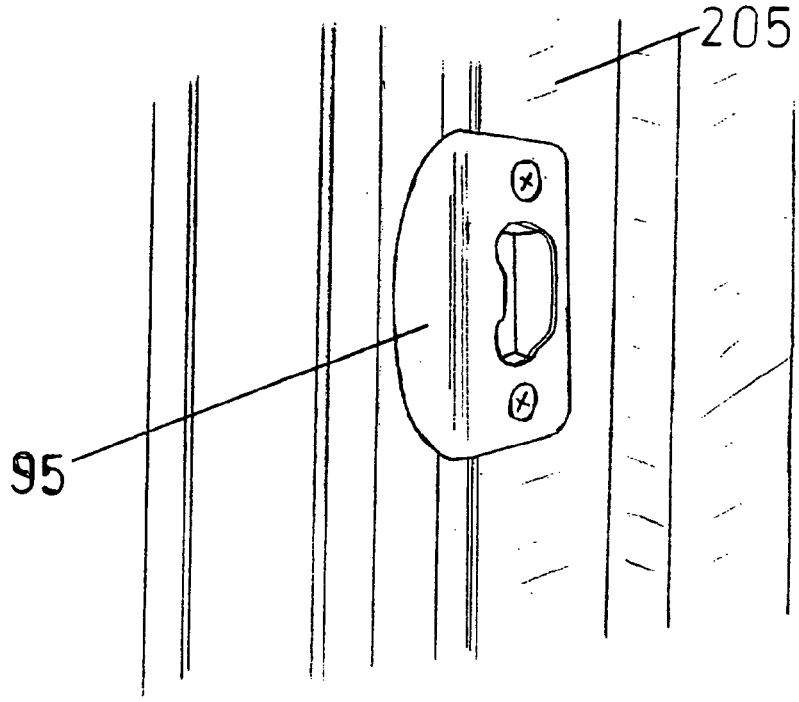
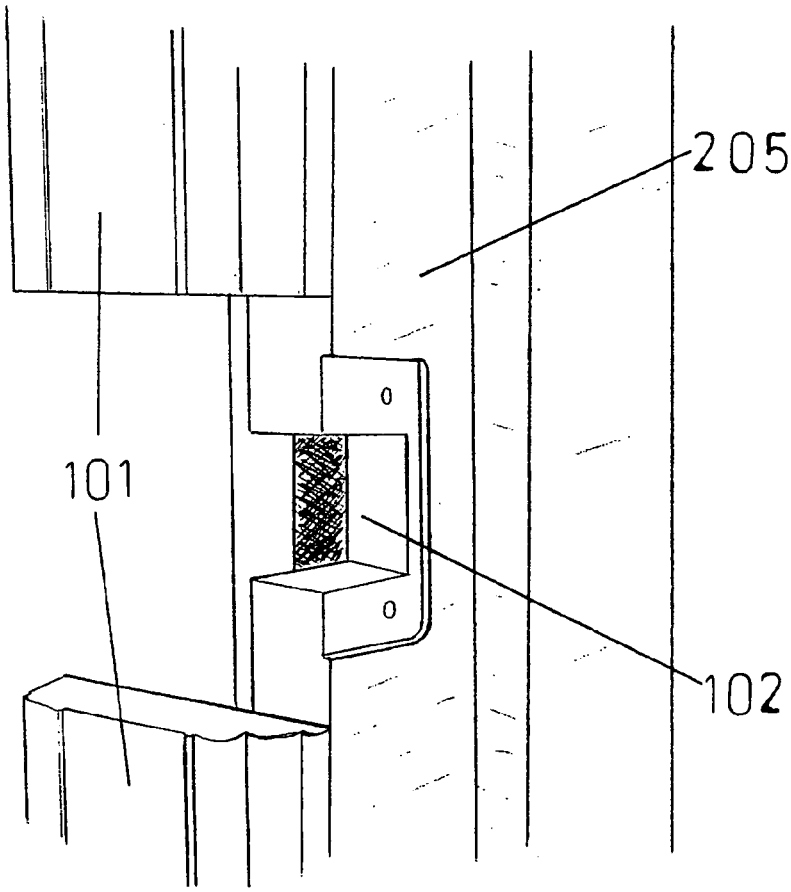
Figure 1B

MASTER ELECTRONICS OVERVIEW

Solenoid Driver

ELECTRONIC TONGUE STRIKE MECHANISM

FIELD OF THE INVENTION

The invention relates generally to the field of door securing mechanisms and more particularly to an electronic strike mechanism.

BACKGROUND

Numerous latching mechanisms have been developed for retaining and/or opening doors. Some of these mechanisms consist of a matched set of hardware for mounting both on the door and the door frame such that the latching device is actuated by an electric solenoid which retracts a latching mechanism on the frame or actuates a mechanism that releases a latching member from engagement with its mating structure mounted on the door. The solenoid may be activated from a remote location to release or lock the door allowing control over door locking and releasing. These mechanisms are typically designed with the door and doorframe and sold as an assembly.

An electric strike assembly is shown in U.S. Pat. No. 5,076,625 in which a door mechanism having a deadlocking-type latch is disclosed. The latch consists of a forked tongue mounted on a pivot shaft so that it may pivot about the axis of the shaft only when released by movement of a rod. The rod in turn is actuated by a manual release bar or by a keeper to rotate slightly counter-clockwise bringing the outer edge of the nub horizontally and thereby release the forked tongue. A spring biases the tongue so that the keeper is returned to its last position only when the door is closed, striking the stop, and rotating the tongue against the force of the biasing spring. The strike is adapted to provide an electric release for doors equipped with a companion forked tongue mechanism.

Another electrically operated securing plate for door locks, mounted inside a door frame, is shown in U.S. Pat. No. 5,195,792. That patent teaches a mechanism having a securing plate and a ratchet means cooperating with the securing plate to retain the securing plate in a locked position. The securing plate pivots about the spindle and is arranged to be moved between an open and closed position by the bolt and to remain in one or the other of these positions. A cam and pin also act as an indicator designed to cooperate with the securing plate in sensing the position of the bolt in relation to a limit breaker or the like when the securing plate is in a closed position. The securing plate is so arranged that by pressing against a side wall of the plate recess during a closing movement, the bolt will force the securing plate from the open door position to the closed door position. It is also arranged so that by pressing against a side wall of the plate recess during an opening movement, the bolt will force the securing plate from the closed door position to the open door position.

While these mechanisms and others within the state-of-the-art provide a securely locked door, they generally require activation of a high voltage high current solenoid by an electric signal to release the door lock. The strike plates and latching mechanisms are specifically designed to bind or otherwise lock when the door is urged and the latching mechanism is in a locked position. In many circumstances, if the door is urged at the same time that the electrical signal is sent to the solenoid for release, binding occurs against the latching mechanism thus preventing it from releasing. Also, the electrical signal that activates the solenoid generally comes from key entry, card swipe or manual handheld button actuating devices thus requiring several actions to open the door. Additionally prior art indicates that present electric strike mechanisms are mounted inside the door frame using high current high voltage solenoids eliminating marketing to the average homeowner handyman. What is needed is a simple door opening mechanism that may be operated in an automated fashion such that binding of the latching mechanism during release is prevented.

SUMMARY

In view of the forgoing, the invention provides an electronic tongue strike mechanism which can be mounted external to a door frame with little door frame modification or door bolt cavity invasion. The electronic tongue strike mechanism consists of a main mounting bracket which is fastened to the door frame, a tension plate which is pivotally mounted to the main mounting bracket, a tongue strike mounted on the tension plate for engaging a door bolt and a pressure sensor mounted on the tension plate to sense relative movement between the tension plate and the main mounting bracket caused by the door bolt being urged against the tongue strike.

BRIEF DESCRIPTION OF THE DRAWINGS

The invention will now be described by way of example with reference to the accompanying figures of which:

FIG. 1A is a perspective view showing a typical strike plate mounted in a doorframe;

FIG. 1B is a perspective view showing doorframe modifications;

DETAILED DESCRIPTION OF THE EMBODIMENTS

Figure 1C:
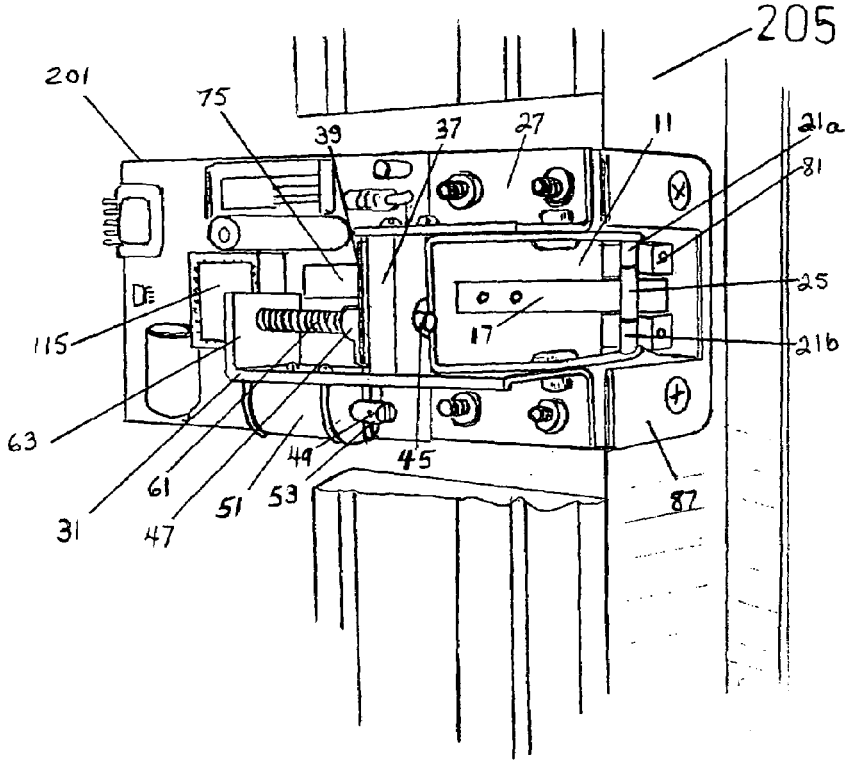
FIG. 1C is a perspective view of the tongue strike mechanism having a cover removed according to the present invention.
Figure 1D:
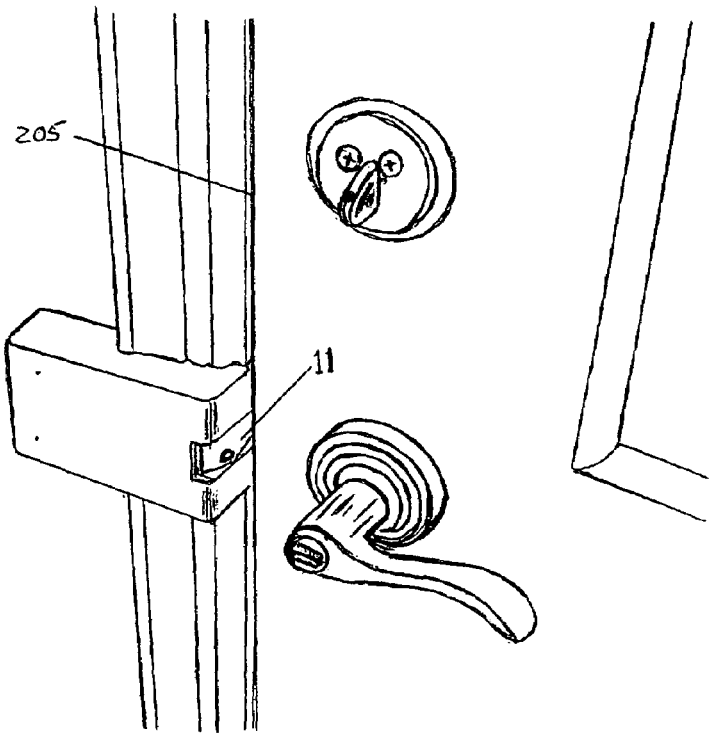
FIG. 1D is a perspective view of the tongue strike mechanism of FIG. 1C having the cover applied.

The invention will now be described in greater detail first with reference to FIGS. 1A-D which show views of an exemplary embodiment of the invention. FIG. 1A shows a typical door strike 95 mounted on a doorframe 205. As shown in FIG. 1B, the door strike 95 has been removed from the doorframe 205 and the door trim 101 has been cut to form an enlarged cavity 102 a shown in FIG. 1C. The electronic tongue strike mechanism 201 is installed within the enlarged cavity 102.

Each of the major components of the electronic tongue strike mechanism 201 will now be described in greater detail.

A mounting bracket 87 supports the assembly within the enlarged cavity 102 and also supports the major components as will now be described in greater detail. A tension plate electronics board 71 is attached to the mounting bracket 87 with suitable fasteners 73*a,b,c,d*. (see FIG. 3). While these and other fasteners that will later be described are shown as screws, it should be understood by those reasonably skilled in the art that other suitable fasteners may be substituted for the screws. The tension plate electronics board 71 is formed of an insulated material such as a PC board and supports the electronics 115 which will which will be described below. A door pressure sensor 75 is mounted on the tension plate electronics board 71 and passes through an opening there in toward the main mounting bracket 87. An upper tongue strike support bracket 27 and a lower tongue strike support bracket 31 are supported on the tension plate electronics board 71 by suitable fasteners 29*a,b* and 35*a,b*. The tongue strike 11 is formed from a plate to have a pair of generally triangular extensions bent from a main portion. It should be understood by those reasonably skilled in the art that the main portion and the triangular extensions bent therefrom may take other shapes. A pair of main bearings 11*a,b* and a pair of tongue strike roller shaft holes 15*a,b* are formed in the triangular extensions. The tongue strike 11 is rotatably mounted to the upper and lower tongue strike support brackets 27, 31 on an upper main bearing shaft 27*a* and a lower main bearing shaft 31*a* which are each inserted into main bearings 11*a,b*. A bias spring 17 is mounted on the inside of the tongue strike 11 and extends outwardly toward the tongue strike roller shaft holes 15*a,b*. Mounted within the strike roller shaft holes 15*a,b* is a strike roller shaft 19 which supports a pair of strike rollers 21*a,b* and of a smaller outside diameter strike roller spacer 25 positioned between the strike rollers 21*a,b*.

Behind the tongue strike 11, the upper and lower tongue strike support brackets 27, 31, also support a tongue strike backstop 37 using tongue strike backstop fasteners 37*a,b,c*, and *d*. The tongue strike backstop 37 is generally rectangular in profile with a clearance opening 38. A latch support hinge 39, generally rectangular in profile with hole 36 therein, is supported by the tongue strike backstop 37 hinge bearing pins 41*a,b* and retained by hinge retainers 43*a,b*. The tongue strike latch 45 is supported by opening 36 on the latch end and on the opposite end by the latch bearing plate 63 bearing hole 64. Latch bearing plate 63 may optionally be formed integral with the lower tongue strike support bracket 31. The latch bearing plate 63 is presently shown attached with latch bearing plate fasteners 65*a,b*. The tongue strike latch 45 is generally cylindrical and has a shoulder 44 formed near a front end thereof. The tongue strike latch 45 supports a tie link 47 having a pin 49 extending there from and also supports an anvil 57 and a latch return spring 61. The tie link 47, anvil 57, and latch return spring 61 are supported on the tongue strike latch 45 between the latch bearing plate hole 64 and the latch support hinge hole 36 to form a hammer/anvil assembly.

A solenoid 51 is mounted on the undersigned of the lower tongue support bracket 31 by suitable fasteners 55*a,b*. A solenoid armature 53 extends forward out of the solenoid 51 for receiving the pin 49 through a solenoid access hole 33 formed in the lower tongue support bracket 31. The solenoid 51 is configured to be powered by a battery so that the tongue strike mechanism 201 may be installed onto an existing door frame without the need to run wires for power to the mechanism.

Figure 2A:
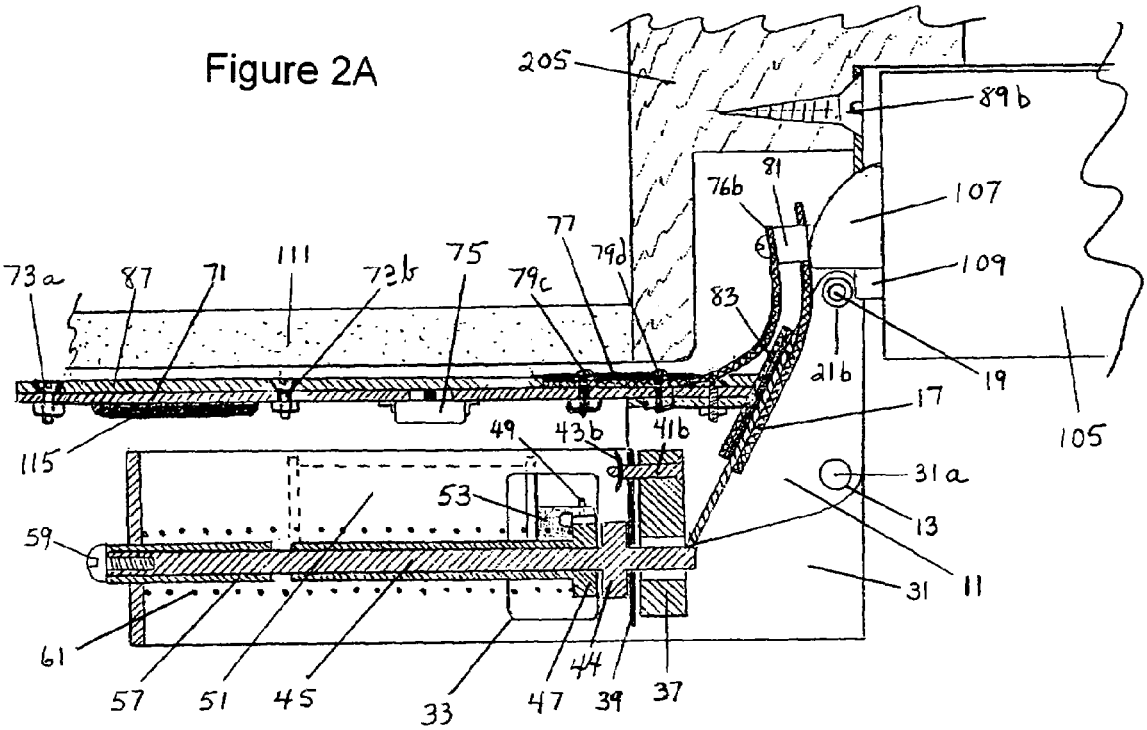
FIG. 2A is a sectional top-down view of the tongue strike mechanism of FIG. 1C shown in the locked position.
Figure 2B:
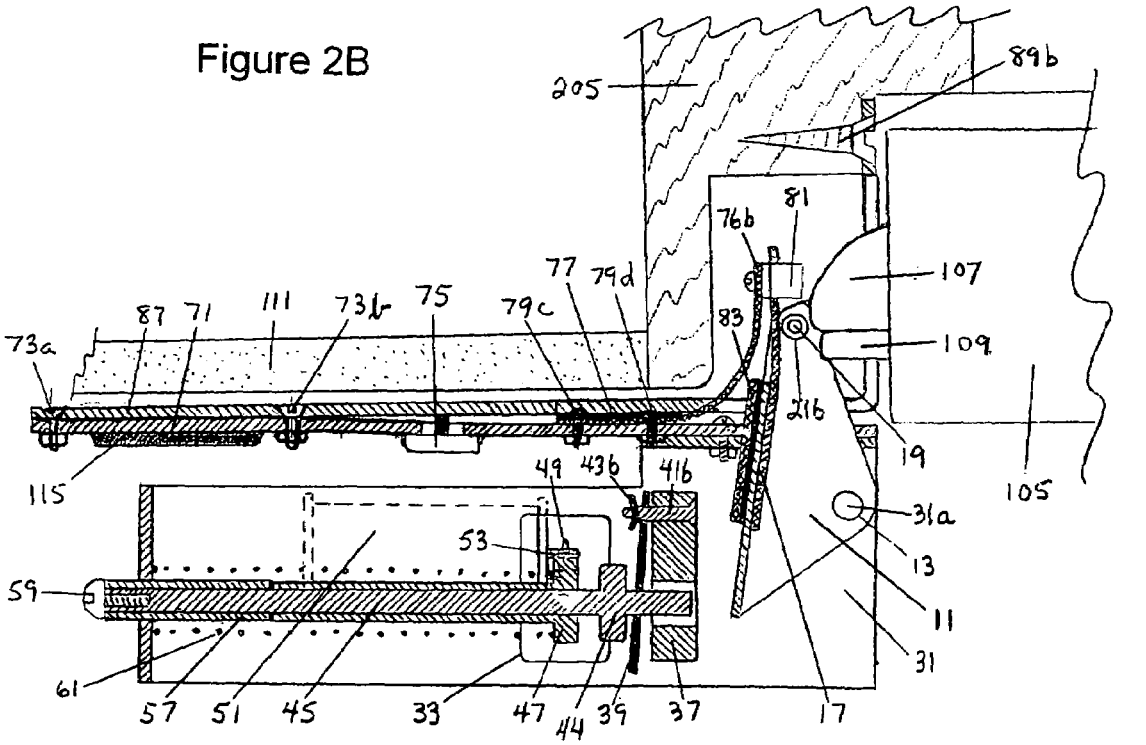
FIG. 2B is a sectional top-down view similar to that of FIG. 2A wherein the tongue strike mechanism is shown in the un-locked position.
Figure 2C:
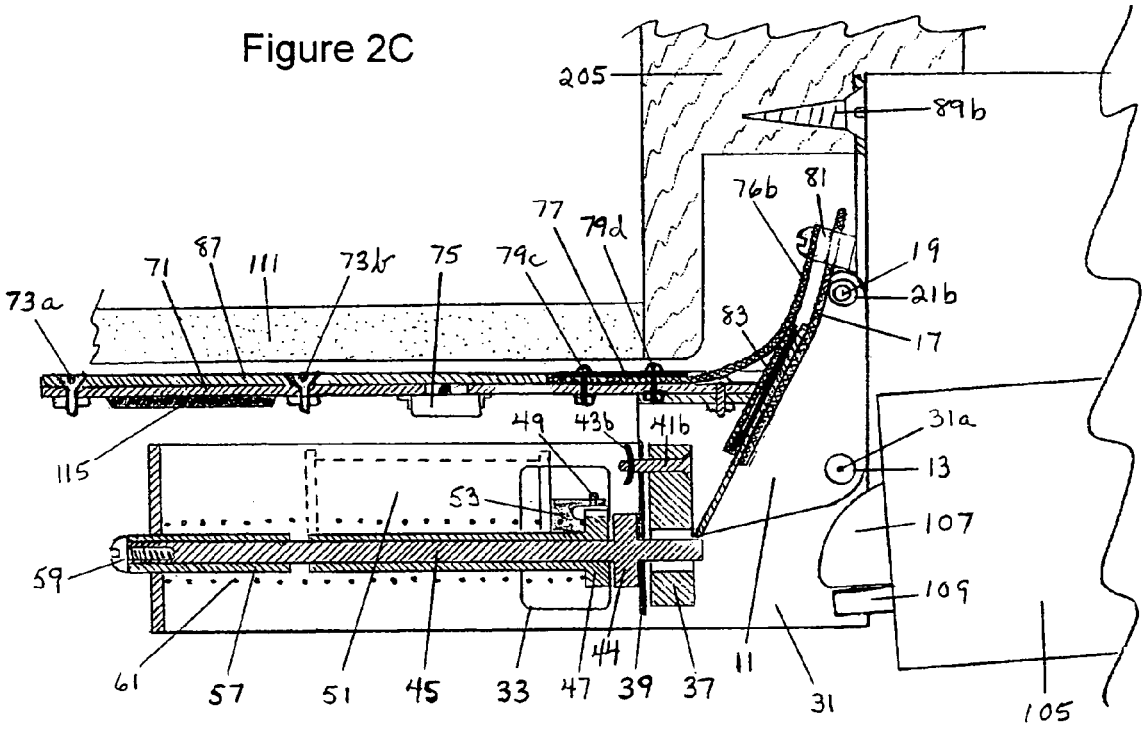
FIG. 2C is a sectional top-down view similar to that of FIG. 2A wherein the door is shown in an open position.
Figure 2D:
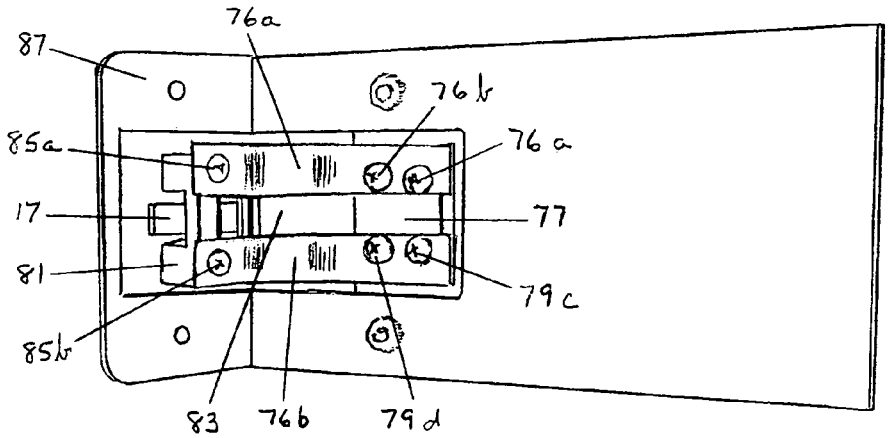
FIG. 2D is a perspective view showing the tongue strike of FIG. 1C from the wall side.
Figure 3:
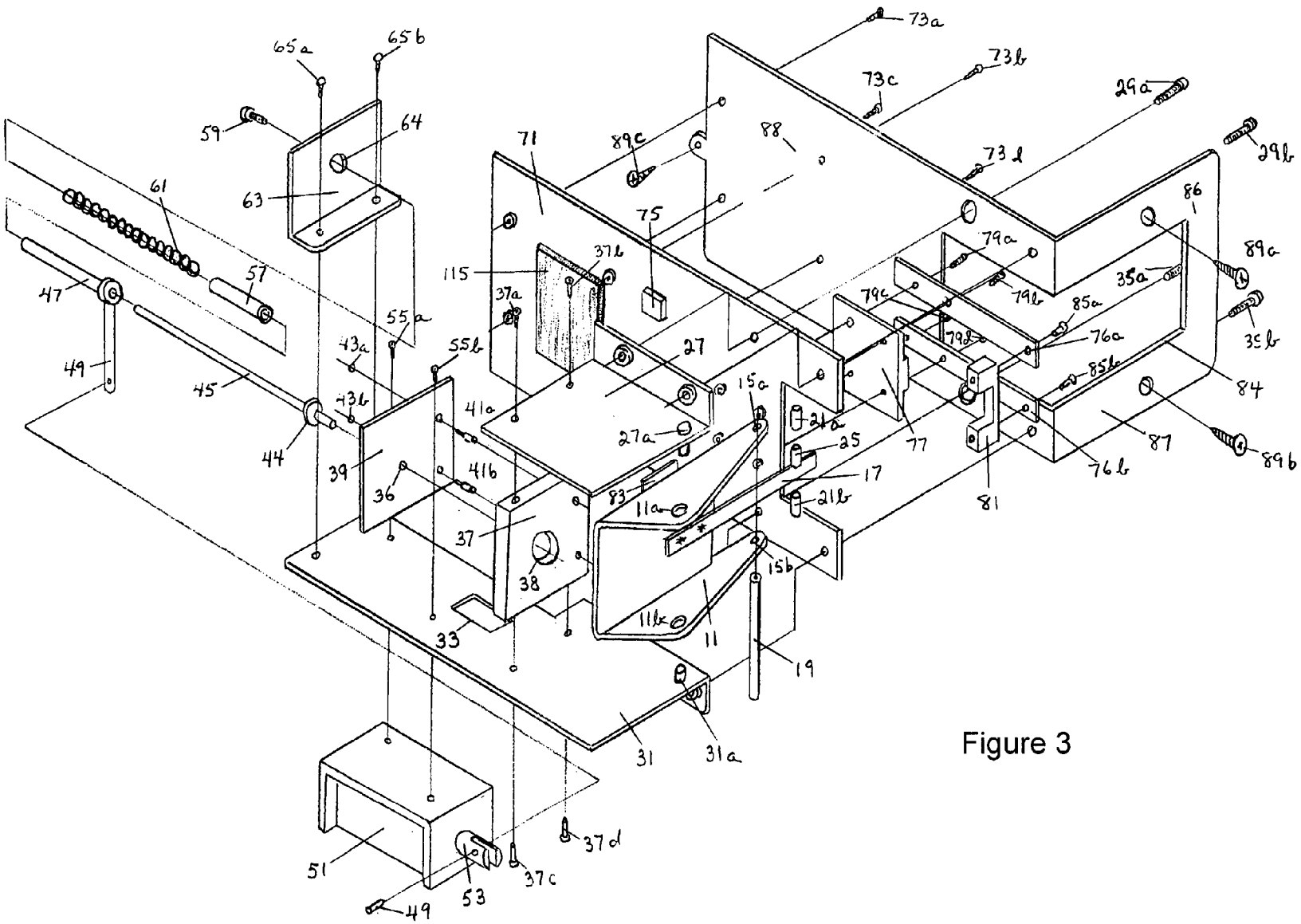
FIG. 3 is an exploded perspective view of the tongue strike mechanism of FIG. 1C.

Turning now to FIGS. 2D and 3, the main mounting bracket 87 and components mounted between it and the tension plate electronics board 71 will be described in greater detail. The main mounting bracket 87 has a generally planar major portion 88 and a generally planer minor portion 86 bent therefrom and mounted to the door frame by main mounting fasteners 89*a,b,c*. An opening 84 is formed between the major and minor portions 88, 86. Control electronics 115 are mounted on the tension plate electronics board 71. A pair of door status contact springs 76*a,b* are mounted on housing 77 located in the vicinity of the opening 84 to PC board 71 using screws 79*a,b,c* and *d*. A door status spring guide 81 is attached to the distal ends of each door status contact springs 76*a,b* located within the opening 84; The tension plate electronics board 71 is mounted to the main mounting bracket 87 by a plurality of suitable board fasteners 73*a,b,c,d* which are located along the major portion 88 at a location which is spaced apart from the opening 84 such that the tension plate electronics board 71 is mounted in a cantilever fashion having a free end near the opening 84. In this arrangement, the tension plate electronics board 71 serves a dual function in that it hosts the electronics 115 needed to control the electronic tongue strike mechanism 201 and some of the mechanical components while it also serves as a tension plate to which the rest of the mechanism is attached that works integral with the door pressure sensor 75 to sense pressure being applied to the door. Two nylon screws 29*b* and 35*b* limit tension plate electronics board 71 movement by being adjusted to make contact with the opposing side of the main mounting bracket 87 allowing enough movement of the tension plate electronics board 71 to activate the door pressure sensor 75 when pressure is applied to the door. Adjustment of the screws may be maintained by lock nuts or Nylock inserts pressed into the upper and lower tongue strike support brackets 27 and 31.

Referring again to FIG. 3 and FIGS. 2A, 2B, it can be seen that the tongue strike 11 is biased and limited in movement by the tongue strike backstop 37 and the door status contact springs 76*a,b*. The bearing geometry is designed such that pressure applied to the door pushes the tongue strike 11 against the tongue strike latch 45 and away from the tongue strike backstop 37.

Unlatching of the tongue strike 11 is accomplished by retracting the tongue strike latch 45 using the solenoid 51 to operate the tie link 47 which actuates the tongue strike latch 45. This is done indirectly through a hammer/anvil assembly described above. The tongue strike latch 45 is supported on the tongue strike 11 end by the latch support hinge hole 36 and on the opposite end by the latch bearing plate hole 64. The latch support hinge 39 therefore provides near zero bearing friction support for the tongue strike latch 45 and is itself supported by hinge bearing pins 41*a,b* pressed into the tongue strike backstop 37. The latch support hinge 39 is retained on the hinge bearing pins 41*a,b* by hinge retainers 43*a,b*. This arrangement facilitates the use of a relatively low power source such as battery power for operating the mechanism.

An electrical assembly consisting of a door status contact spring housing 77, door status contact springs 76*a,b* and door status contact spring guide 81 provides for door status signals to the control electronics 115 which will be described in greater detail below. The door status contact spring housing 77 and the door status contact springs 76*a,b* are electrically connected to the tension plate electronics board 71 by door status contact spring fasteners 79*a,b,c,d*. The door status contact spring guide 81 is attached to the other end of door status contact springs 76*a,b* by door status contact spring guide fasteners 85*a,b*. A door status spring commutator 83 is mounted on the back of the tongue strike 11 and is electrically isolated therefrom by an insulative layer. This assembly in combination with the door status contact spring commutator 83 provides a method of communicating the open/closed status of the door to the control electronics 115.

Figure 5:
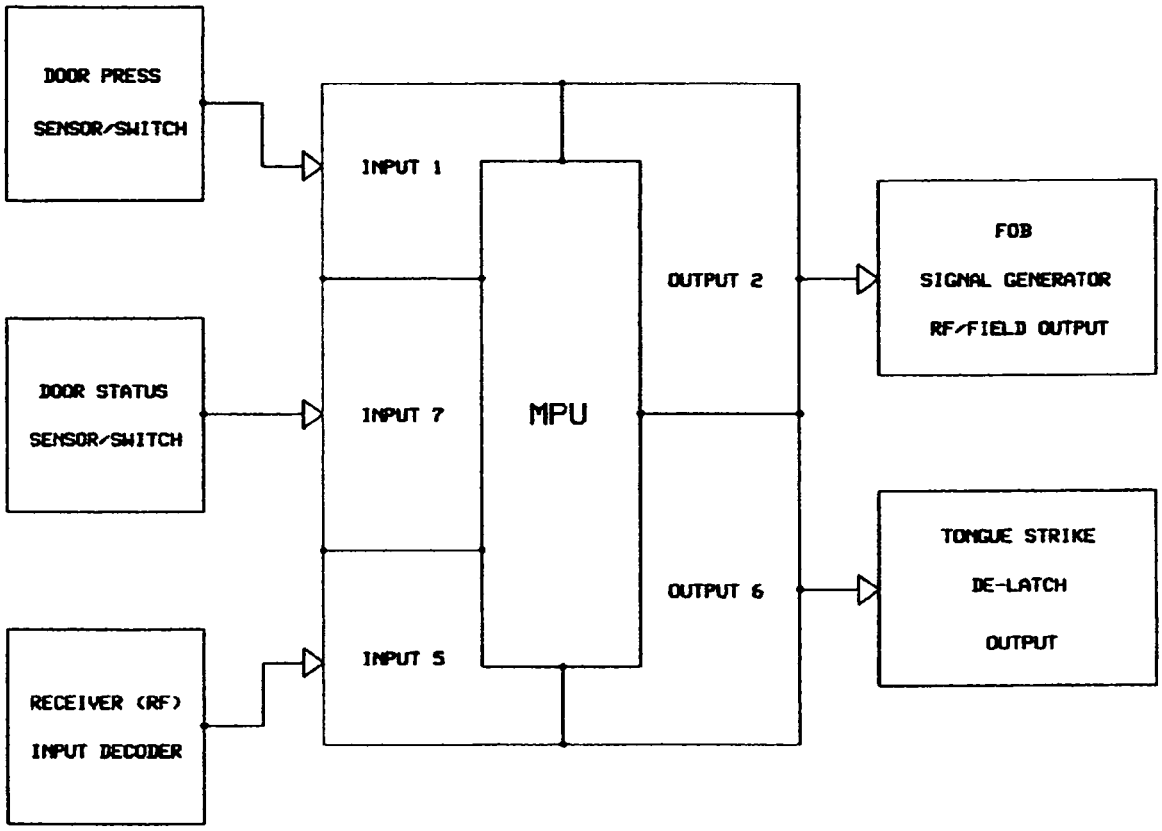
FIG. 5 is a block diagram supporting flowchart, FIG. 4 showing an overview of electronics for operating the tongue strike mechanism.

Referring now to FIG. 5, the control electronics 115 will be described in greater detail with reference to this block diagram which shows an exemplary implementation for the control electronics 115. A microprocessor unit (MPU) or like control unit, receives input signals from the door pressure sensor 75 at input 1, the door status contact springs 76*a,b* at input 7 and a radiofrequency decoded signal at input 5 coming from a buttonless fob or other remote control actuation device. The MPU operates on these inputs to generate an output to the fob signal generator at output 2 and an output for driving the solenoid 51 at output 6.

Operation of the electronic tongue strike mechanism 201 will now be described in greater detail. In the door locked position shown in FIG. 2A, the tongue strike latch 45 is held extended by the latch return spring 61 pressing between bearing plate 63 and latch shoulder 44. In the latch extended position, the tongue strike 11 is blocked from pivoting. With no pressure applied to the door 105, the tension plate electronics board 71 lies flat against the main mounting bracket 87 causing the door pressure sensor 75 actuator to be depressed which indicates no pressure is being applied the door 105. The large door bolt 107 in this instance is directly deflecting the bias spring 17 and indirectly deflecting the door status contact springs 76*a,b* through the door status contact spring guide 81. The deflection of door status contact springs 76*a,b* breaks electrical contact with the door status contact spring commutator 83 indicating to the control electronics 115, the door is closed.

Fasteners 29*a* and 35*a* pass through and clear enlarged holes in the main mounting bracket 87 attaching the entire tongue strike assembly to tension plate electronics board 71 thereby electrically isolating the assembly so that an oscillating field can be induced by the control electronics 115 into the assembly which makes electrical contact with bolts 107 and 109 causing this oscillating field to be imparted to the door lock assembly and ultimately to the person touching the door knob while the door is closed. A remote control device such as a keyless button-less fob device on the person is sensitive to the field generated around the person touching the door knob. The remote control device will, upon sensing the field, send a coded signal to the transceiver on the control electronics 115 which will operate the solenoid 51 if the code is correct.

Figure 4:
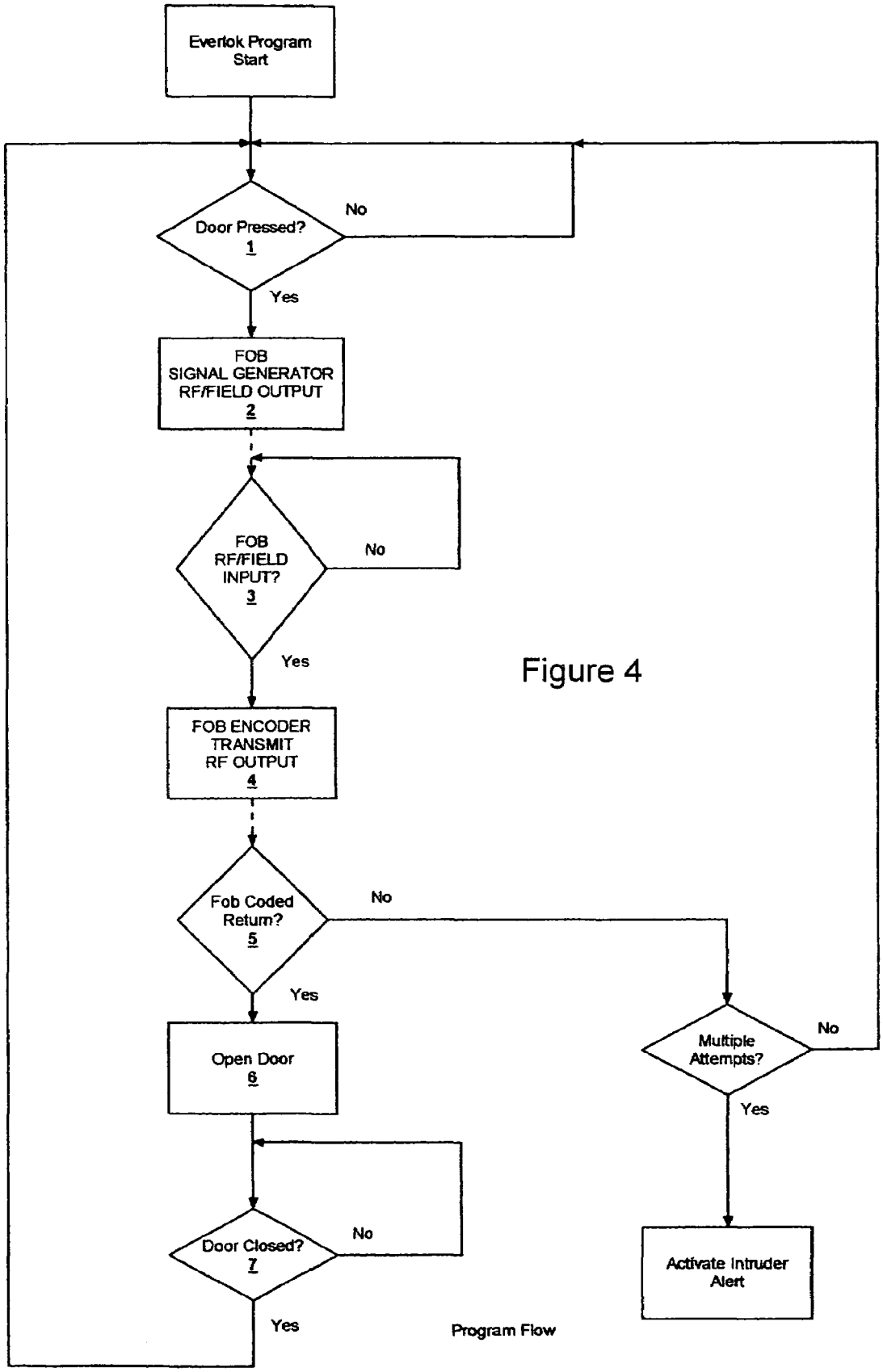
FIG. 4 is a flowchart describing an algorithm for operation of the tongue strike mechanism.

An algorithm for controlling the solenoid with the remote control device is described in FIG. 4. After program start, the control electronics 115 checks if the door is pressed at step 1. If so, a radiofrequency field is output from its signal generator at step 2. A remote-control device or buttonless fob senses the radiofrequency field at step 3 and transmits a unique identification code back to the control electronics 115 at step 4. If the control electronics 115 receives the correct unique identification code from the remote-control device at step 5 then it sends a signal to solenoid 51 to open the door 105 at step 6. Once the control electronics 115 senses that the door is closed at step 7, the process returns to Step 1, to check if door pressed. In the event that multiple door press attempts result in incorrect codes or no return signals to the control electronics 115 at step five, the control electronics 115 may optionally activate an intruder alert system which may optionally be tied to an alarm or other indicator for recording an attempted intrusion.

In the door pressed and locked position shown in FIG. 2A, pressing the door 105 translates pressure to the large door bolt 107 which in turn imparts pressure to the tongue strike 11 causing the tension plate electronics board 71 to flex away from the main mounting bracket 87. The door pressure sensor 75 attached to the tension plate electronics board 71 senses this flexing and sends a signal to the control electronics 115 causing an oscillating signal to be sent to the electrically isolated tongue strike assembly as described above. If the buttonless fob returns a valid signal to the transceiver on the control electronics 115 then a pulse from the solenoid driver on the control electronics 115 causes the solenoid 51 to pull in the solenoid armature 53. The solenoid armature is attached to the hammer solenoid tie link 47 by the hammer solenoid tie pin 49. The gap lying between the hammer/solenoid tie link 47 and the anvil 57 allows the hammer solenoid tie pin 47/49 to accelerate un-opposed until it makes contact with the anvil 57. The energy stored in the hammer solenoid tie link 47/49 during acceleration is imparted to the anvil 57 which imparts it's accelerated energy to the anvil retainer FIG. 59 attached to the hammer/solenoid tie pin 47/49. This hammer anvil concept assists the tongue strike latch 45 to release the tongue strike 11 under relatively low power such as that provided by a battery.

Figure 6:
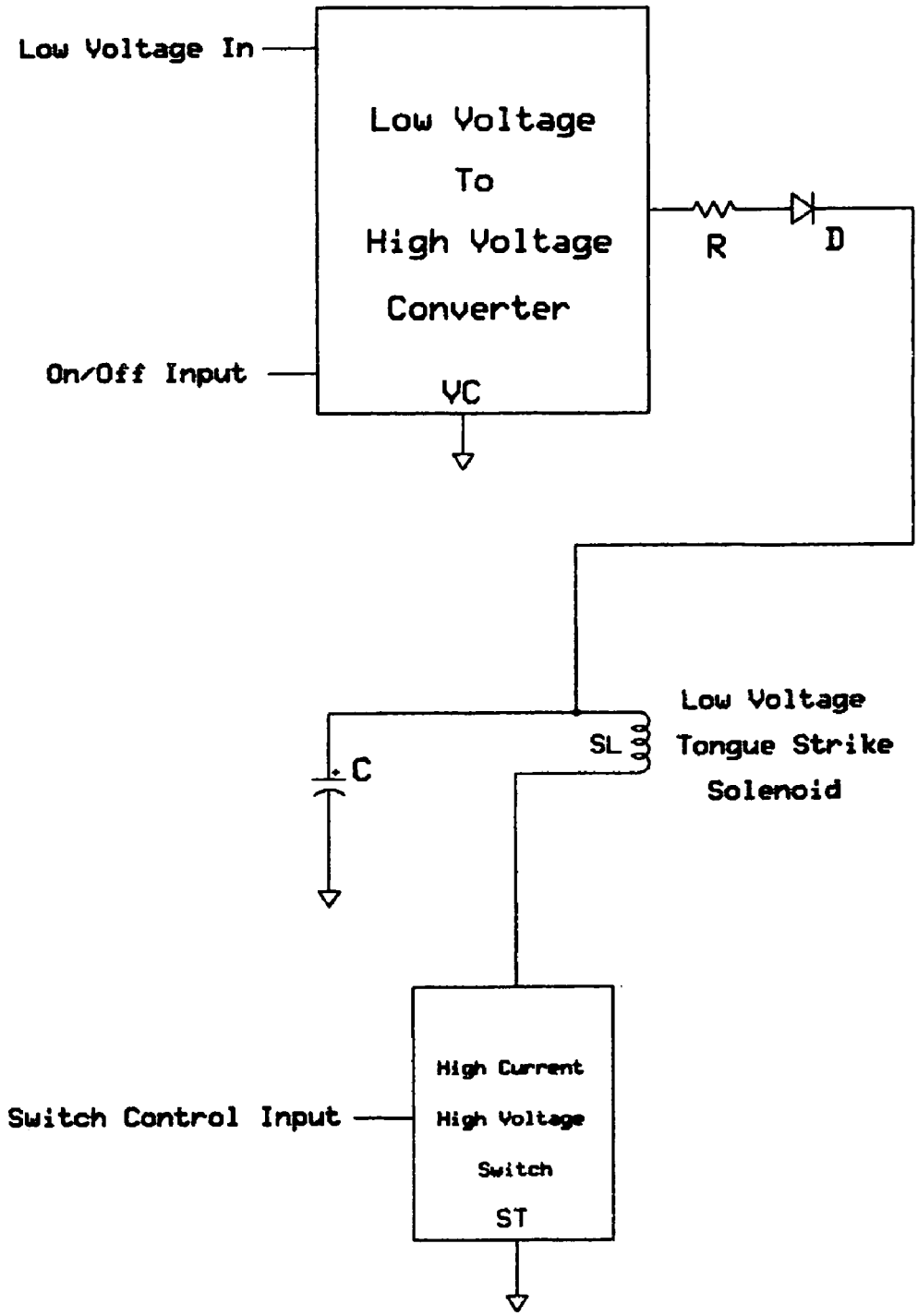
FIG. 6 is a block diagram of a solenoid driver according to the invention.

Reference will now be made to FIG. 6 showing a block diagram of a solenoid driver circuit according to an embodiment of the invention. Assume that low voltage (battery) is always applied to the converter VC input. A on pulse from a control device such as the MPU is applied to the On/Off input of the voltage converter VC with enough duration to charge up the capacitor C with a high voltage. Resistor R is a current limit resistor that limits the amount of current to safe levels during charge up to protect the Voltage Converter VC. The diode D blocks voltage from bleeding back into the Voltage Converter VC when the Voltage Converter VC is turned off. Once charged up, the capacitor will hold a charge for many hours depending on the components used.

Once the capacitor C is charged, it generally holds it's charge until a pulse arrives from a control device such as the MPU. When the pulse arrives, a large surge voltage/current is placed across the low voltage solenoid SL causing the solenoid SL to briefly be overdriven resulting in brief excessive force being applied to the solenoid armature 53.

This brief excessive force is translated to the hammer of the hammer/anvil system. Because there is a gap between the hammer and anvil system this extreme force is free to accelerate with no restriction amplifying the hammer/anvil effect. This synergy between the hammer/anvil and solenoid drive assures the latch 45 will release the tongue strike 11. Additionally this electronic scheme allows a larger selection of battery types due to the indirect operation of the solenoid by the capacitor rather than direct solenoid operation by the battery.

Once unlatched (see FIG. 2B) the tongue strike 11 is pushed away from the large door bolt by three forces. First, the geometry of the tongue strike main bearings 31*a,b* and the tongue strike roller shaft 19 is controlled by the location of tongue strike backstop 37 such that pressure applied to the door causes the tongue strike 11 to move away from the tongue strike backstop 37. The more force applied to the door 105 the more the tongue strike 11 is urged to swing to the open position. Secondly, the large bolt 107 has been imparting it's spring energy to the bias spring 17 which further encourages the tongue strike 11 to move to the open position. Lastly the spring energy stored in the small door bolt 109 is imparted to the tongue strike 11 via contact with strike roller spacer 25. It should be understood by those skilled in the art that the small door bolt 109 is not present on all doors. Its use here to import spring energy on the tongue strike 11 is therefore optional.

FIGS. 2A and B show the door 105 in the closed or partially closed position where door status contact springs 76*a,b* do not come in contact with the door status contact spring commutator 83. When in contact with the door status contact springs 76*a,b*, the door status contact spring commutator 83 completes a circuit between the doors status contact springs 76*a, b*. This indicates to the control electronics 115 that the door 105 is not fully open. FIG. 2C shows the door 105 in the open position causing door status contact springs 76*a,b* to come in contact with door status contact spring commutator 83 completing a circuit as described above indicating to the control electronics 115 that the door is open.

The embodiment of the electronically based door strike mechanism is advantageously located primarily external to a door frame and uses a tongue strike extending into the door frame to make contact with traditional door bolts. Additionally the door strike mechanism utilizes parts geometry and door bolt spring energy to allow efficient battery operation coupled with electronic and radio technology to affect a keyless/button-less secure home or business entry system. Advantageously provided herein is the opportunity to offer a door entry system for installation by the average handy consumer. Additionally the electronic tongue strike mechanism offers efficient door release capability such that battery operation can be used.

The pressure sensor advantageously feeds electronics which through radio means operates to securely release the tongue strike through button-less key fob devices.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electronic tongue strike mechanism comprising:

a main mounting bracket which is mountable onto a door frame;

a tension plate which is mounted to the main mounting bracket, wherein the tension plate is mounted in a cantilever fashion to the main mounting bracket at an end thereof which is remote from an opening for receiving a door bolt;

a tongue strike mounted on the tension plate for inwardly engaging the door bolt;

a pressure sensor mounted on the tension plate to sense relative movement between the tension plate and the main mounting bracket caused by the door bolt being urged against the tongue strike;

a bias spring mounted on the tongue strike such that it extends into the opening for receiving the door bolt; and upper and lower tongue strike support brackets mounted on the tension plate for supporting the tongue strike therebetween;

wherein each of the upper and lower tongue strike support brackets has a main bearing shaft onto which the tongue strike is rotatably mounted.

2. The electronic tongue strike mechanism of claim 1 wherein the tongue strike comprises a pair of generally triangular extensions extending generally orthogonally from a main portion.

3. The electronic tongue strike mechanism of claim 2 further comprising a main bearing disposed on each extension for receiving a respective one of the main bearing shafts.

4. The electronic tongue strike mechanism of claim 1 further comprising a pair of strike rollers mounted on the tongue strike by a strike roller shaft.

5. The electronic tongue strike mechanism of claim 1 further comprising a pair of door status contact springs mounted within a door status contact spring housing between the main mounting bracket and the tension plate near the opening for receiving the door bolt.

6. The electronic tongue strike mechanism of claim 5 wherein the door status contact springs extend into the opening at a free end thereof.

7. The electronic tongue strike mechanism of claim 6 further comprising a door status contact spring guide mounted between the free ends of the door status contact springs, the door status contact spring guide engaging the bias spring at a free end thereof.

8. The electronic tongue strike mechanism of claim 7 further comprising a tongue strike backstop mounted between the upper and lower tongue strike support brackets behind the tongue strike for limiting rotational movement of the tongue strike.

9. The electronic tongue strike mechanism of claim 8 further comprising a tongue strike latch which is engageable with the tongue strike through an opening in the tongue strike backstop.

10. The electronic tongue strike mechanism of claim 9 further comprising a solenoid which is operatively connected to the tongue strike latch for driving the latch away from engagement with the tongue strike.

11. The electronic tongue strike mechanism of claim 9 further comprising a solenoid driver having at least one storage capacitor which is discharged through the solenoid upon solenoid operation.

12. The electronic tongue strike mechanism of claim 11 wherein the solenoid driver further comprises a voltage converter for upconverting battery voltage to a relatively higher voltage for charging the storage capacitor.

13. The electronic tongue strike mechanism of claim 12 wherein the solenoid driver further comprises a controllable switch for controlling charging and discharging of the storage capacitor.

14. The electronic tongue strike mechanism of claim 8 wherein the tongue strike is biased toward the tongue strike backstop by the door status contact springs.

15. The electronic tongue strike mechanism of claim 14 wherein pressure applied to the door pushes the tongue strike away from the tongue strike backstop and against a tongue strike latch.

16. The electronic tongue strike mechanism of claim 12 wherein the tongue strike latch comprises an elongated generally cylindrical member having a shoulder disposed near its front end proximate the tongue strike backstop.

17. The electronic tongue strike mechanism of claim 16 further comprising a tie link disposed on the tongue strike latch proximate the shoulder, the tie link being operatively connected to an armature of the solenoid.

18. The electronic tongue strike mechanism of claim 17 further comprising an anvil disposed on the tongue strike latch proximate the tie link.

19. The electronic tongue strike mechanism of claim 17 further comprising a latch return spring disposed on the tongue strike latch proximate the anvil at one end and against a latch bearing plate on its opposite end.

20. The electronic tongue strike mechanism of claim 19 further comprising a latch support hinge disposed between the shoulder and the tongue strike backstop.

21. The electronic tongue strike mechanism of claim 20 wherein the latch support hinge is hingeably mounted on the tongue strike backstop by hinge bearing pins and retainers.

22. The electronic tongue strike mechanism of claim 21 wherein the tongue strike latch is supported in a hole disposed in the latch support hinge.

23. The electronic tongue strike mechanism of claim 7 further comprising a door status spring commutator disposed on the main portion of the tongue strike for contacting the door status contact springs.

24. An electronic tongue strike mechanism comprising:

a main mounting bracket which is mountable onto a door frame;

a tongue strike disposed on the main mounting bracket for inwardly engaging a door bolt;

a tongue strike latch which is engageable with the tongue strike through an opening in a tongue strike backstop, the tongue strike latch having an elongated generally cylindrical member having a shoulder disposed near its front end proximate the tongue strike backstop;

a solenoid which is operatively connected to the tongue strike latch for driving the tongue strike latch away from engagement with the tongue strike, the solenoid having an armature;

a solenoid driver having at least one storage capacitor which is discharged into the solenoid upon operation of the solenoid; and a tie link disposed on the tongue strike latch proximate the shoulder, the tie link being operatively connected to the armature;

wherein the solenoid driver further comprises a voltage converter for upconverting battery voltage to a relatively higher voltage for charging the at least one storage capacitor and a controllable switch for controlling charging and discharging of the at least one storage capacitor;

wherein the tongue strike is biased toward the tongue strike backstop by door status contact springs; and wherein pressure applied to a door pushes the tongue strike away from the tongue strike backstop and against the tongue strike latch.

25. The electronic tongue strike mechanism of claim 24 further comprising an anvil disposed on the tongue strike latch proximate the tie link.

26. The electronic tongue strike mechanism of claim 25 further comprising a latch return spring disposed on the tongue strike latch proximate the anvil at one end and against a latch bearing plate on its opposite end.

27. The electronic tongue strike mechanism of claim 26 further comprising a latch support hinge disposed between the shoulder and the tongue strike backstop.

28. The electronic tongue strike mechanism of claim 27 wherein the latch support hinge is hingeably mounted on the tongue strike backstop by hinge bearing pins and retainers.

29. The electronic tongue strike mechanism of claim 28 wherein the tongue strike latch is supported in a hole disposed in the latch support hinge.

30. The electronic tongue strike mechanism of claim 29 further comprising a door status spring commutator disposed on the main portion of the tongue strike for contacting the door status contact springs.

31. The electronic tongue strike mechanism of claim 28 further comprising a pressure sensor mounted on a tension plate being pivotally mounted to the main mounting bracket and supporting the tongue strike to sense relative movement between the tension plate and the main mounting bracket caused by a door bolt being urged against the tongue strike, the pressure sensor being operatively connected to cause actuation of the solenoid.

* * * * *